US006352164B1

(12) United States Patent
Hyatte et al.

(10) Patent No.: US 6,352,164 B1
(45) Date of Patent: Mar. 5, 2002

(54) STORAGE RACK HAVING LOCKING BEAM-TO-COLUMN CONNECTION

(75) Inventors: Richard L. Hyatte, Rolling Prairie, IN (US); Jeffrey M. Cortez, Woodridge, IL (US)

(73) Assignee: Paltier, L.L.C., Michigan City, IN (US)

( * ) Notice: Subject to any disclaimer, the term of this patent is extended or adjusted under 35 U.S.C. 154(b) by 0 days.

(21) Appl. No.: 09/624,215

(22) Filed: Jul. 18, 2000

Related U.S. Application Data

(60) Provisional application No. 60/144,937, filed on Jul. 20, 1999.

(51) Int. Cl.[7] ..... A47B 47/00

(52) U.S. Cl. ..... 211/192

(58) Field of Search ..... 211/192, 190, 211/191, 187; 248/222.11, 222.41, 222.12, 222.13, 222.14, 221.11, 220.21, 218.4, 219.1, 219.3; 4063/247, 324, 325, 327, 328, 316, 318, 254, 255, 348, 349, 358

(56) References Cited

U.S. PATENT DOCUMENTS

| | | | | | |
|---|---|---|---|---|---|
| 1,702,937 | A | | 2/1929 | Friedemann | |
| 1,847,486 | A | | 3/1932 | Keil | |
| 3,273,720 | A | * | 9/1966 | Seiz | 211/192 |
| 3,303,937 | A | | 2/1967 | McConnell | |
| 3,330,583 | A | | 7/1967 | Kennedy et al. | |
| 3,392,848 | A | * | 7/1968 | McConnell et al. | 211/192 |
| 3,475,044 | A | * | 10/1969 | Konstant | |
| 3,601,432 | A | | 8/1971 | Fenwick et al. | |
| 3,612,290 | A | | 10/1971 | Evans | |
| 3,638,981 | A | * | 2/1972 | Weider | |
| 3,680,711 | A | | 8/1972 | Brucker | |
| 3,697,034 | A | | 10/1972 | Shell | |
| 3,741,405 | A | | 6/1973 | McConnell et al. | |
| 3,871,525 | A | | 3/1975 | Al-Dabbagh et al. | |
| 3,905,712 | A | | 9/1975 | McConnell | |
| 3,986,318 | A | | 10/1976 | McConnell | |
| 4,074,812 | A | | 2/1978 | Skubic et al. | |
| 4,165,944 | A | * | 8/1979 | Sunasky | 403/254 |
| 4,171,789 | A | | 10/1979 | Vander Hoek et al. | |
| 4,222,542 | A | | 9/1980 | Wilson et al. | |
| 4,285,436 | A | * | 8/1981 | Konstant et al. | 211/192 |
| 4,406,374 | A | | 9/1983 | Yedor | |
| 4,411,298 | A | | 10/1983 | Ellingsen et al. | |
| 4,421,239 | A | * | 12/1983 | Vargo | 211/187 |
| 4,496,061 | A | * | 1/1985 | Highsmith | 211/191 |
| 4,550,893 | A | | 11/1985 | Wiersema et al. | |
| 4,618,064 | A | | 10/1986 | Viklund | |
| 4,632,222 | A | | 12/1986 | Chen | |
| 4,708,252 | A | | 11/1987 | Azzi | |
| 4,729,484 | A | | 3/1988 | McConnell | |
| 4,955,743 | A | | 9/1990 | King | |

(List continued on next page.)

*Primary Examiner*—Daniel P. Stodola
*Assistant Examiner*—Jennifer E. Novosad
(74) *Attorney, Agent, or Firm*—Seyfarth Shaw

(57) ABSTRACT

An adjustable rack system has a column with a plurality of teardrop shaped slots and a beam having a connecting bracket that connects the beam to the column. The connecting bracket can be an L-shaped bracket with a recessed portion in one of the legs of the L. A plurality of connectors extend from the surface of the bracket and are adapted for insertion into a large upper portion of the teardrop shaped slots and then moved downward to the bottom portion of the teardrop shaped slots. A locking pin is provided that extends through an opening in the recessed portion and is movable between an extended position where the locking pin projects beyond the recessed portion and a retracted position where the locking pin does not project beyond the recessed portion. A spring is coupled to the locking pin and can be located at least partially within the indentation. The spring biases the locking pin towards the extended position such that the locking pin is biased into the large upper portion of one of the teardrop shaped slots when the beam and column are connected.

29 Claims, 10 Drawing Sheets

U.S. PATENT DOCUMENTS 5,025,937 A 6/1991 King
5,063,715 A 11/1991 Goodman
5,131,781 A 7/1992 Klein
5,243,720 A * 9/1993 Harrow
5,350,074 A 9/1994 Rosenband
5,494,246 A 2/1996 McCarthy et al.
5,624,045 A * 4/1997 Highsmith et al. ..... 211/192
5,713,476 A 2/1998 Highsmith et al.
5,758,988 A 6/1998 Theodorou
5,791,502 A 8/1998 Bietz et al.
5,938,367 A 8/1999 Olson
6,155,441 A * 12/2000 Andersen et al. ..... 211/192
6,230,910 B1 * 5/2001 Olsson et al. ..... 211/192

* cited by examiner

STORAGE RACK HAVING LOCKING BEAM-TO-COLUMN CONNECTION

RELATED APPLICATIONS

This application claims the benefit of the filing date of copending U.S. Provisional Application Ser. No. 60/144,937, filed Jul. 20, 1999.

BACKGROUND OF THE INVENTION

The present invention relates to structures made from beams and columns that are removably connected to one another. The invention has particular application to storage racks, especially those incorporating a locking mechanism to prevent accidental disconnection of a beam from a column.

Various types of locking mechanisms have been used for storage racks that comprise removably connected beams and columns. Examples of locking mechanisms used with such storage racks are shown in U.S. Pat. Nos. 4,074,812 and 5,624,045, the disclosures of which are incorporated herein by reference.

Some locking mechanisms rely on gravity to keep a locking mechanism in the locked position. However, these locking mechanisms are often attached to a beam that also relies on gravity to remain connected to a column. Unfortunately, this type of locking mechanism might be accidently lifted out of the locked position by the same force that lifts the beam out of connection with a column. This is especially true as wear and tear occurs and gravity cannot move the locking mechanism past a damaged area.

Other storage racks include a locking mechanism that has a large portion of the mechanism located on the exterior of a beam. This type of exposed locking device can be easily damaged, for example by the mishandling of a forklift.

Other locking mechanism are not very strong and can be easily disengaged when a large force is exerted against a beam. This can cause the locking mechanism to fail a beam uplift test.

Thus, the strength and durability of these prior locking mechanisms are necessarily limited.

SUMMARY OF THE INVENTION

It is a general object of the invention to provide an improved storage rack of interconnecting beams and columns and locking mechanism therefor which avoid the disadvantages of prior locking storage racks, while affording additional structural and operating advantages.

A feature of the invention is the provision of a locking mechanism that has minimal exposure to damage because the majority of the locking mechanism is disposed in use in the interior of the storage rack.

A different feature of the invention is the provision of a locking support mechanism that strengthens the locking mechanism so it can be subjected to greater forces during a beam uplift test.

Another feature of the invention is the provision of a locking support mechanism that is also used to connect a beam to a column.

A different feature of the invention is the provision of a locking mechanism including a recessed portion whereby the locking mechanism can be withdrawn when it is disengaged.

The invention consists of certain novel features and a combination of parts hereinafter fully described and illustrated in the accompanying drawings, it being understood that various changes in the details may be made without departing from the spirit, or sacrificing any of the advantages of the present inventions.

BRIEF DESCRIPTION OF THE DRAWINGS

For the purpose of facilitating an understanding of the inventions, there are illustrated in the accompanying drawings preferred embodiments thereof, from an inspection of which, when considered in connection with the following description, the inventions, its construction and operation, and many of its advantages should be readily understood and appreciated.

DESCRIPTION OF THE PREFERRED EMBODIMENTS

Figure 1:
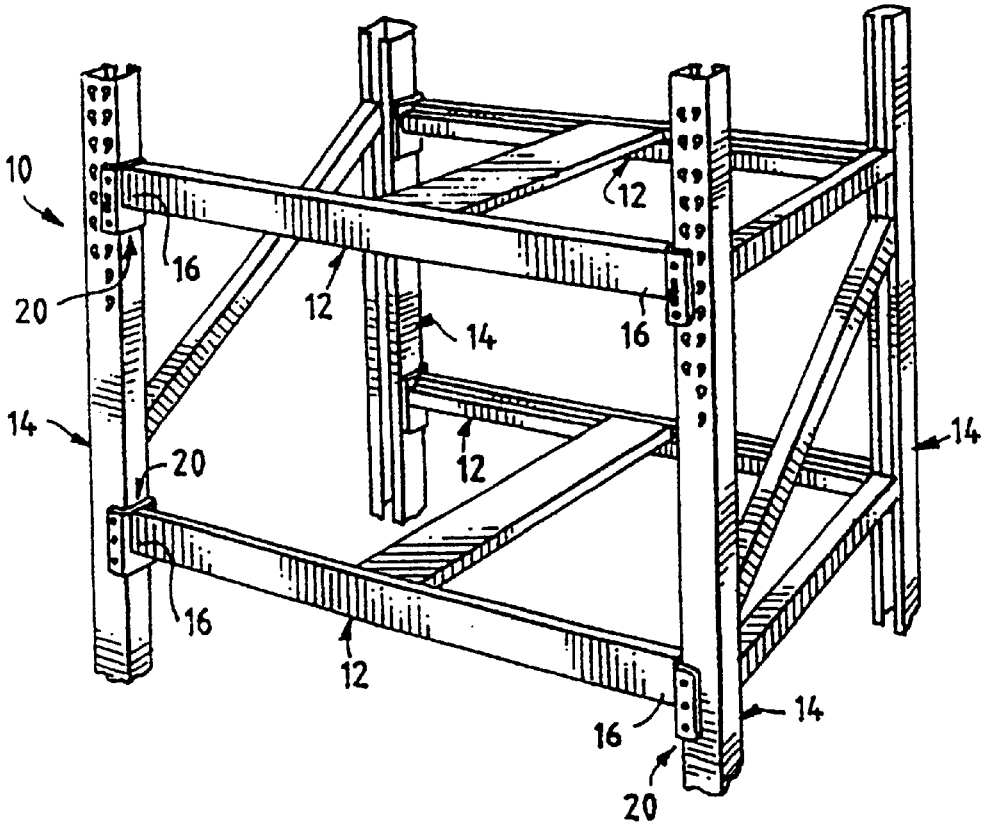
FIG. 1 is a fragmentary, perspective view of a storage rack constructed of interlocking beams and columns in accordance with the invention.
Figure 2:
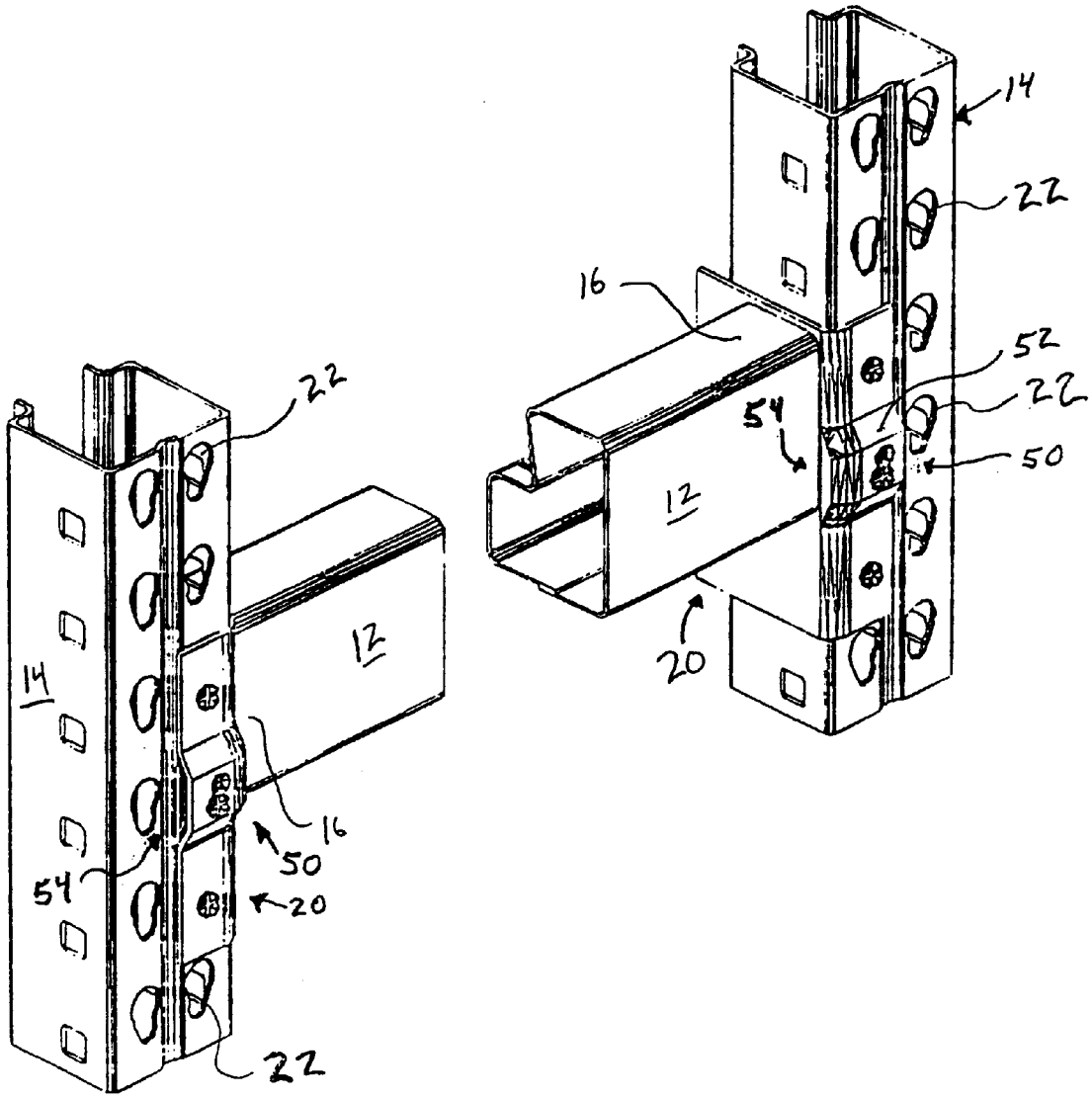
FIG. 2 is an enlarged, fragmentary, perspective view of beam and columns interconnected according to a preferred embodiment of the invention.
Figures 3A, 3B, 3C, 3D, 3E, 3F, 3G, 3H:
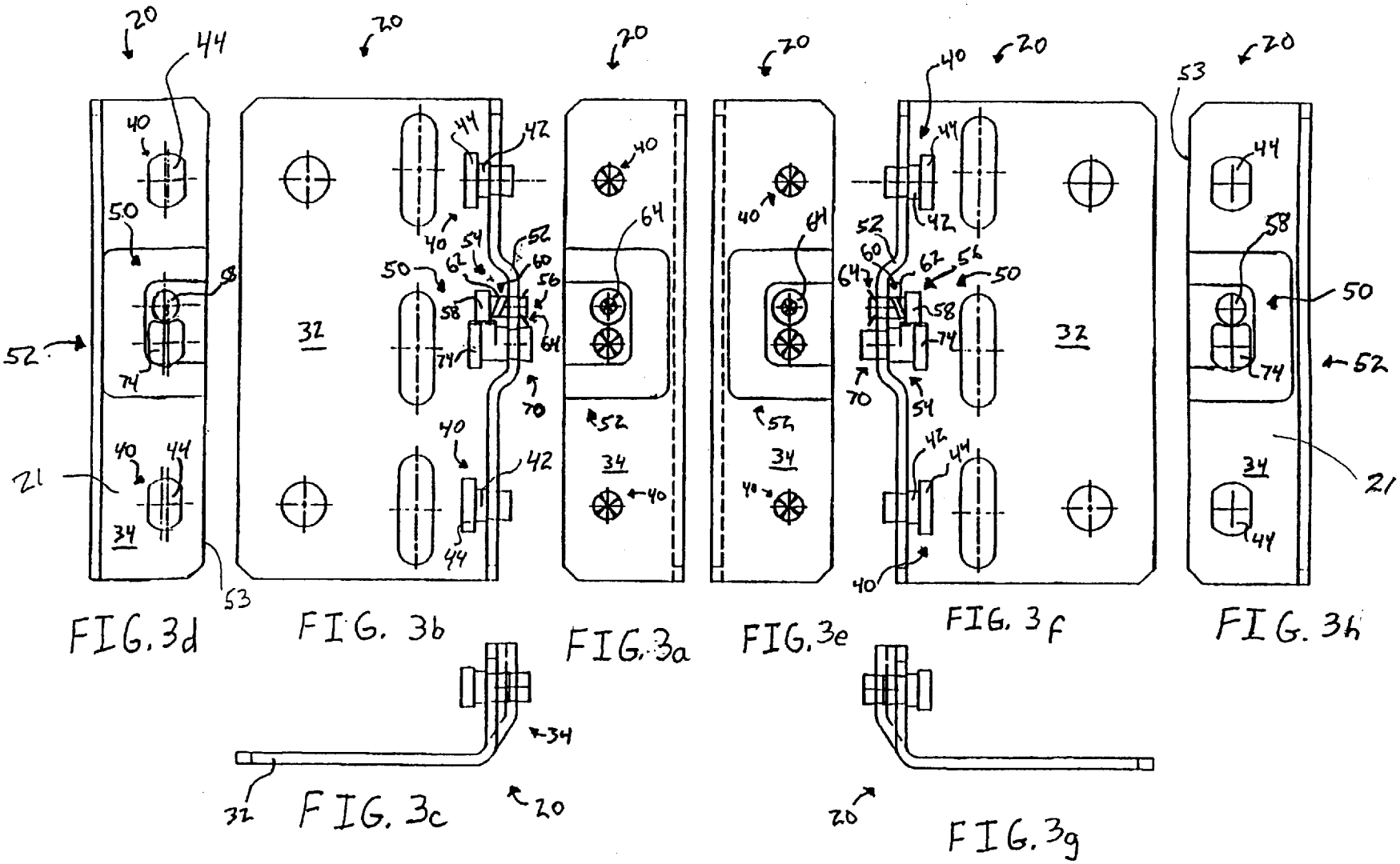
FIG. 3*a* is an enlarged, front elevational view of a left hand connecting structure of the beam of FIG. 2.
FIG. 3*b* is a side elevational view of the connecting structure of FIG. 3*a;*
FIG. 3*c* is a bottom plan view of the connecting structure of FIG. 3*b;*
FIG. 3*d* is a rear elevational view of the connecting structure of FIG. 3*b;*
FIG. 3*e* is an enlarged, front elevational view of a right hand connecting structure of the beam of FIG. 2.
FIG. 3*f* is a side elevational view of the connecting structure of FIG. 3*e;*
FIG. 3*g* is a bottom plan view of the connecting structure of FIG. 3*e;*
FIG. 3*h* is a rear elevational view of the connecting structure of FIG. 3*e;*
Figure 4A:
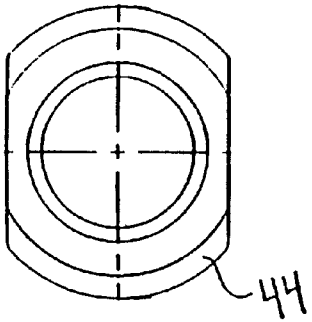
FIG. 4*a* is a further enlarged end elevational view of a support connector of the connecting structure of FIG. 3*b;*
Figure 4B:
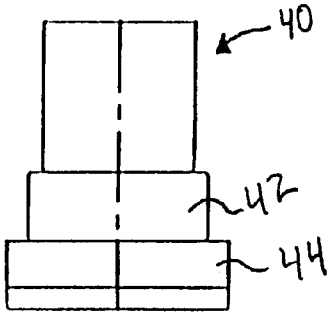
FIG. 4*b* is a bottom plan view of the support connector of FIG. 4*a;*
Figure 4C:
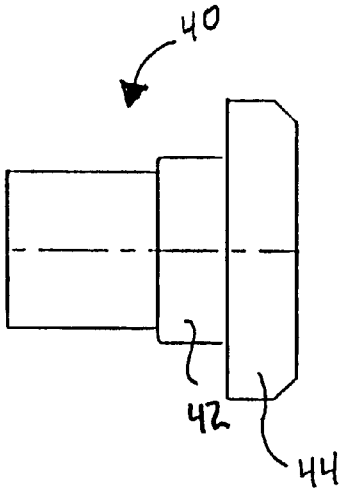
FIG. 4*c* is a side elevational view of the support connector in FIG. 4*a;*
Figure 5B:
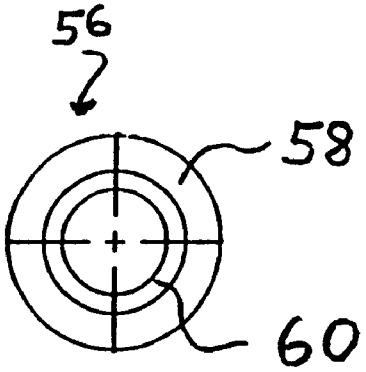
FIG. 5*b* is an end elevational view of the locking pin of FIG. 5*a;*
Figure 5A:
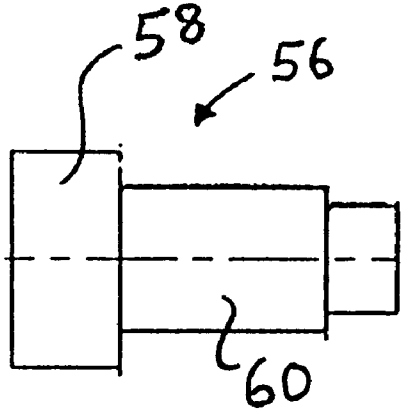
FIG. 5*a* is an enlarged side elevational view of the locking pin of the connecting structure of FIG. 3*b;*
Figure 6B:
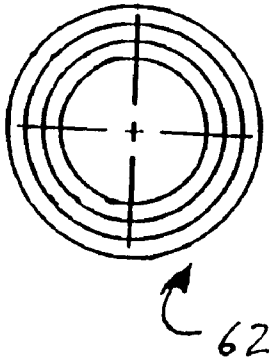
FIG. 6*b* is an end elevational view of the spring of FIG. 6*a;*
Figure 6A:
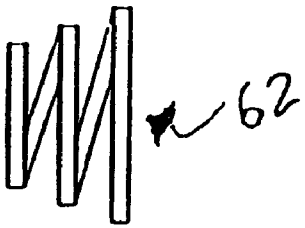
FIG. 6*a* is an enlarged side elevational view of the spring of the connecting structure of FIG. 3*b;*
Figure 7C:
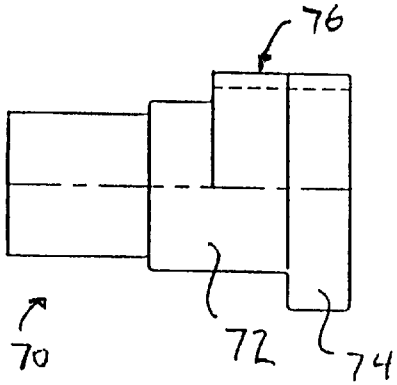
FIG. 7*c* is a side elevational view of the locking support of FIG. 7*a;*
Figure 7A:
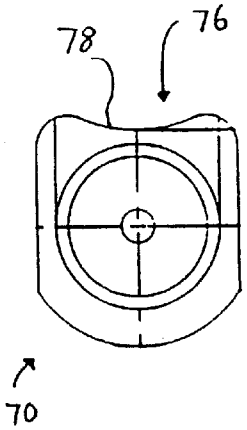
FIG. 7*a* is an enlarged end view of the locking support of the connecting structure of FIG. 3*b;*
Figure 7B:
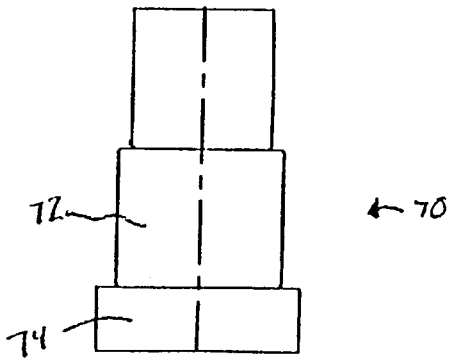
FIG. 7*b* is a bottom plan view of the locking support of FIG. 7*a;*
Figure 8:
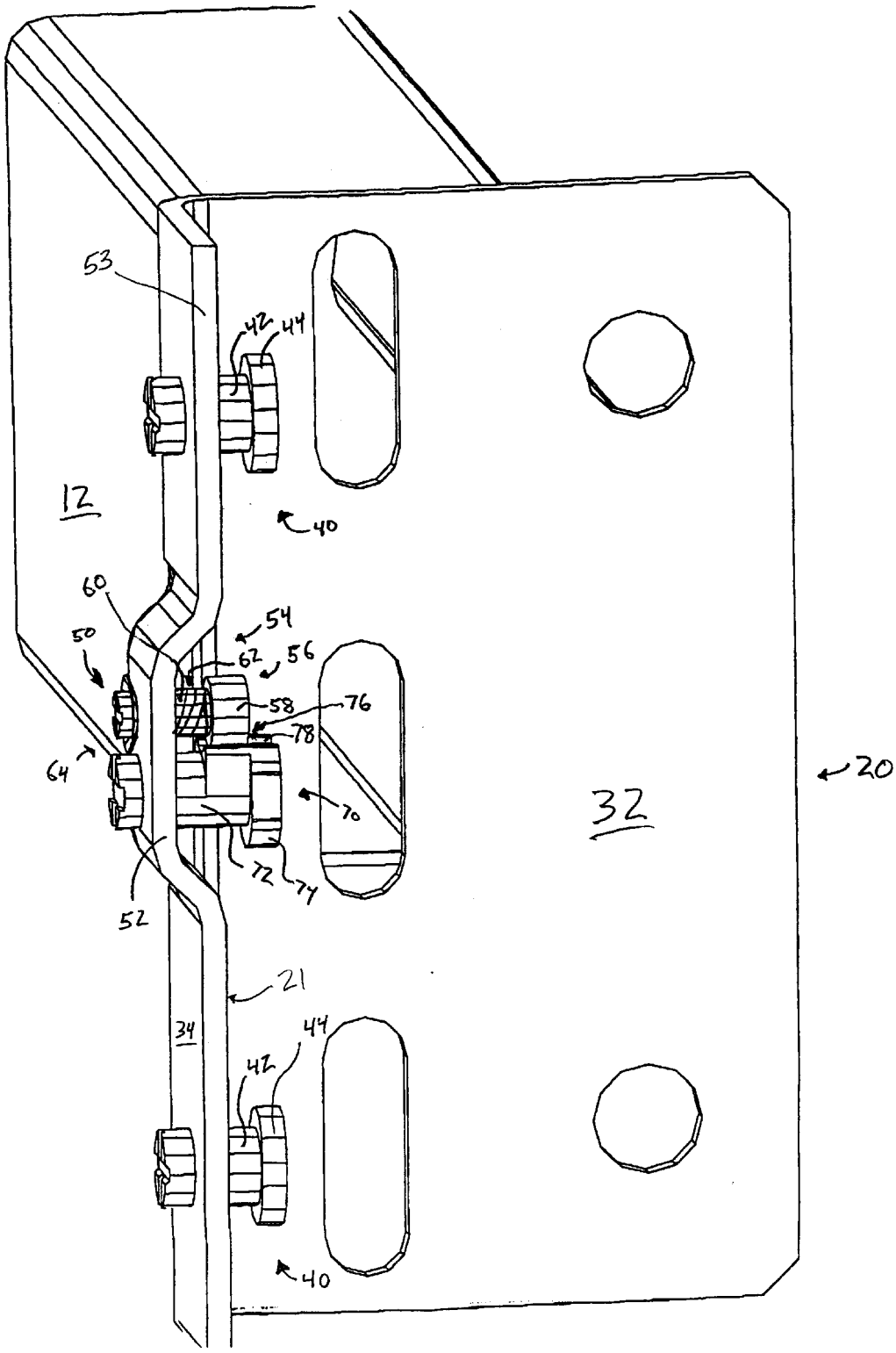
FIG. 8 is CAD drawing of a further enlarged, fragmentary, perspective view of a beam and connecting structure of the invention with the locking pin in a locked position.
Figure 9:
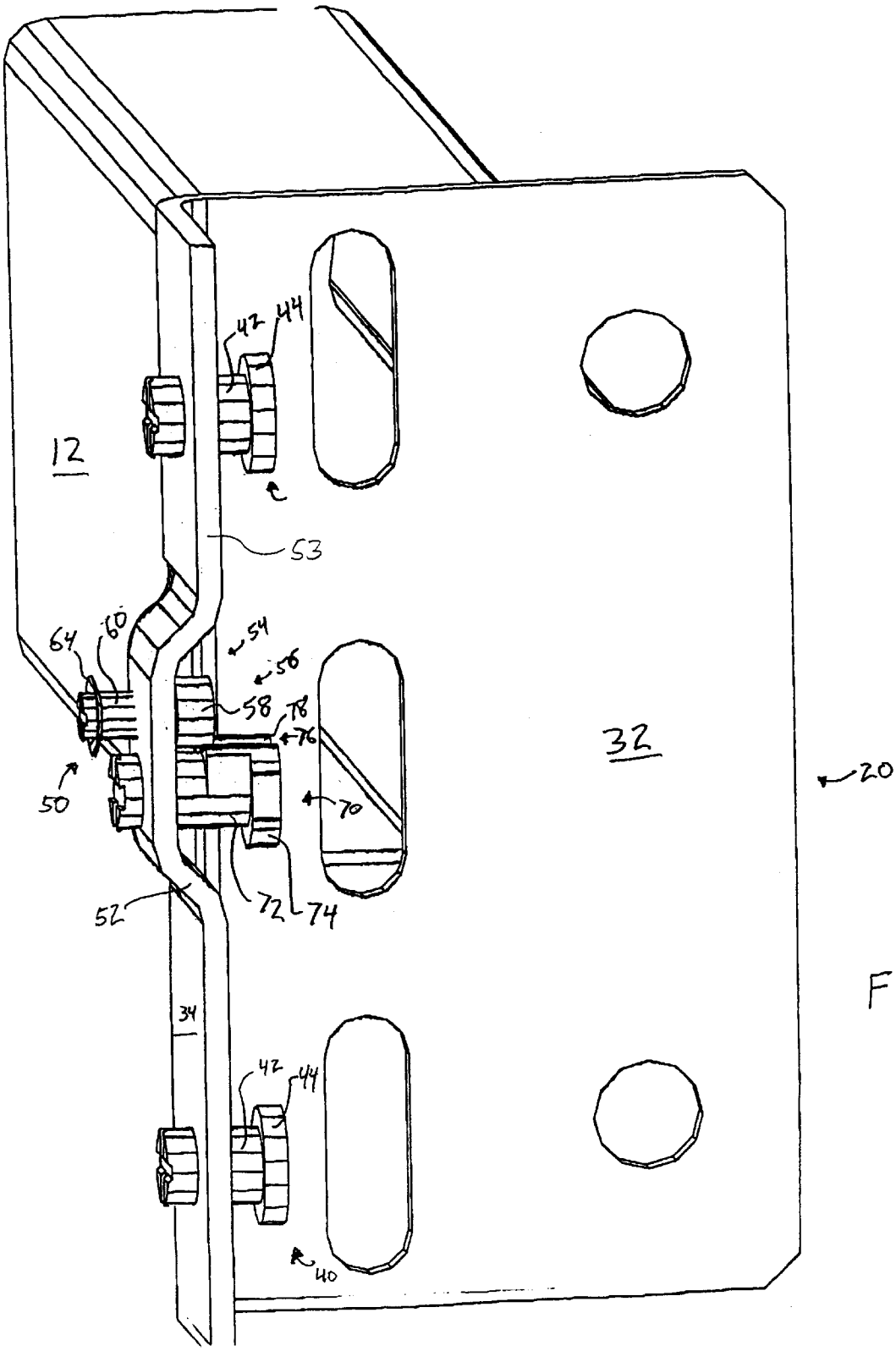
FIG. 9 is a view similar to FIG. 8 with the locking pin in an open position.
Figure 10:
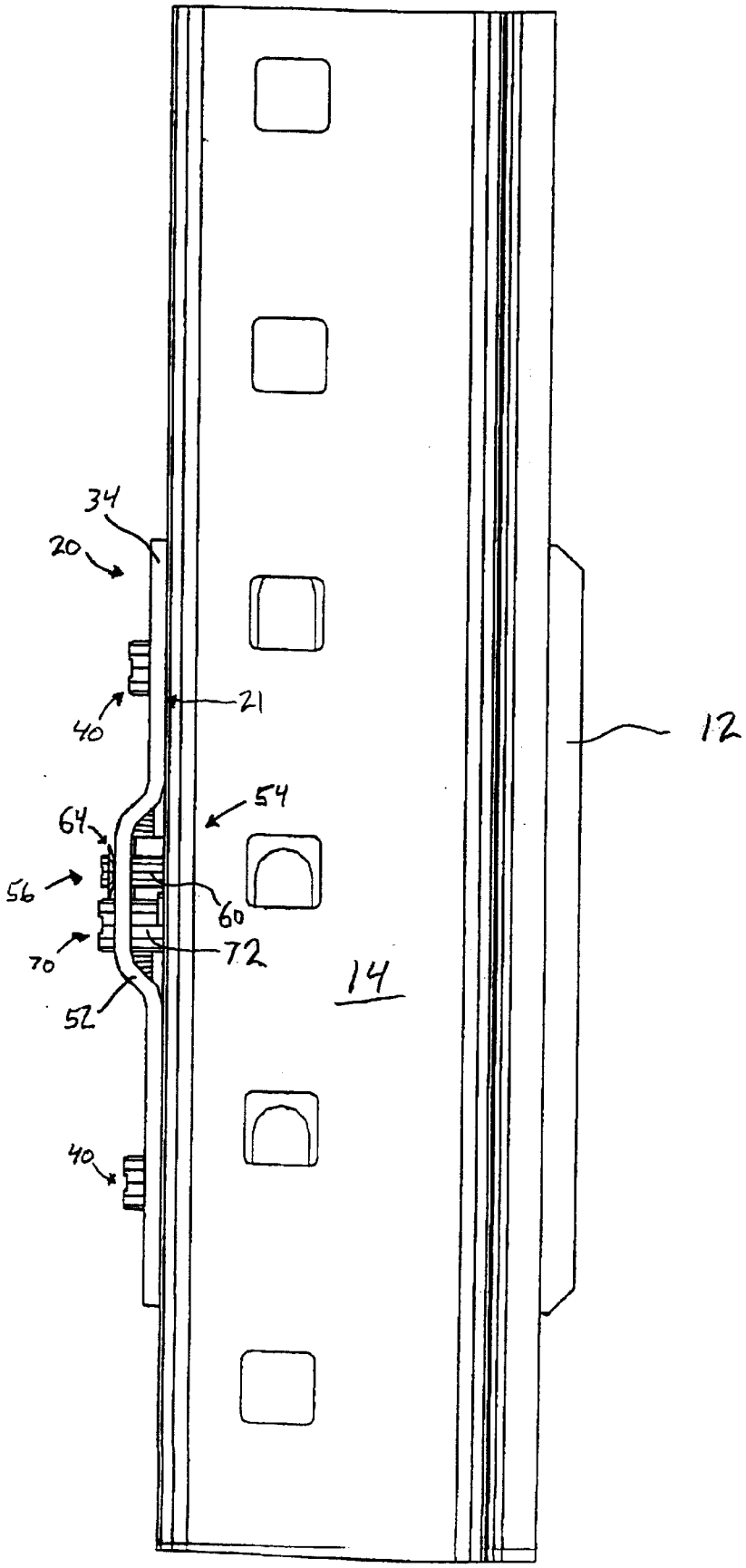
FIG. 10 is CAD drawing of a further enlarged, fragmentary, side elevational view of the beam and columns interconnection of FIG. 1, as viewed from the right-hand side thereof.

Referring to FIGS. 1, 2, and 10, there is illustrated interconnected rack members, such as a beam and column structures forming an adjustable storage rack system 10. Beams 12, are connected to columns 14 by connecting structures, such as L-shaped connecting brackets 20, respectively at ends 16 of each beam 12. When the beams and columns are connected together, a first surface 21 of the connecting bracket 20 lays substantially flat against column 14, as seen in FIGS. 2 and 10.

In one form, each column 14 can be a conventional design of the type disclosed in the aforementioned U.S. Pat. No. 4,074,812, including two parallel, vertical arrays of similar, regularly spaced, teardrop or modified keyhole-shaped openings or slots, such as apertures 22. Each aperture 22 is wider at an upper region and narrower at a lower region. As used herein, directional terms, such as "upper," "lower," "vertically," and "horizontally," refer to the storage rack 10 as erected and disposed on a substantially horizontal underlying support surface. Each connecting structure 20 comprises a side flange 32, which is perpendicular to the associated beam 12 and which is welded so as to be integral with an end 16 of the associated beam 12, and a front flange 34, which is perpendicular to the side flange 32.

Referring to FIGS. 3*a* through 4*c*, in a preferred form, front flange 34 has at least one weight-bearing connector 40, such as the depicted stud. Connector 40 can be attached to front flange 34 by any suitable fastening method, one such method being disclosed in the aforementioned U.S. Pat. No. 5,624,045. In a preferred form, connector 40 has a shaft, such as shank 42, and a head 44.

Each connector 40 is designed to connect beam 12 to column 14 using an aperture 22. The head 44 of connector 40 is sized and shaped so as to be capable of passing through the wider, upper region of aperture 22 to a first position. However, head 44 should be designed so that it is not capable of passing through the narrower, lower region of aperture 22. The shank 42 of connector 40 is sized and shaped so as to be capable of passing through either of the upper and lower regions of aperture 22. Therefore, when an end 16 of a beam 12 is connected to a column 14 by connecting structure 20, shank 42 of the connector 40 is moved down in aperture 22 so that it rests in the bottom of the aperture 22 in a second position.

Referring to FIGS. 2 through 3*h* and 8–10, at least one locking mechanism 50 is provided and preferably includes an indentation or recessed portion, such as depression 52, formed in a portion of one surface of flange 34 of connecting structure 20. In one form, the depression 52 is formed along a free edge 53 of flange 34. Depression 52 faces column 14to form protective pocket 54 when the beam 12 and column 14 are assembled. Protective pocket 54 is sized to encompass the more delicate elements of the locking mechanism 50 and shields the locking mechanism 50 from damage. In a preferred form, depression 52 is located approximately midway between the upper and lower ends of front flange 34 of connecting structure 20.

The locking mechanism 50 includes a locking pin 56 (see FIGS. 3*b*, 3*f*, 5*a*, and 5*b*). In a preferred form, locking pin 56 comprises pin head 58 and pin shank 60. The pin head 58 of locking pin 56 is sized and shaped so as to be capable of fitting within the wider, upper region of aperture 22. Locking pin 56 is attached to front flange 34 through an aperture or hole (not shown).

In the preferred form, the hole will be located within depression 52 and situated so that pin head 58 will fit within the wider, upper region of aperture 22 when the beam and column are assembled. Locking pin 56 can be attached to flange 34 with any suitable fastener or fastening method that will allow pin shank 60 to slide axially back and forth (see FIGS. 8 and 9) within the hole, while simultaneously retaining locking pin 56 within the hole.

A biasing member (see FIGS. 3*b*, 3*f*, 6*a*, 6*b*, and 9), such as a helical compression spring 62, encircles the shank 60 and biases pin head 58 away from the flange 34 to a rest position or extended position (see FIGS. 8 and 9) wherein the head 58 is in vertical alignment with the shank 42 of each connector 40 so as to be disposed within its column aperture 22 when the beam 12 is connected to the column 14, as shown in FIG. 10. The locking pin 56 is situated, with respect to connectors 40, so that, when an attempt is made to lift a beam 12 from its interconnecting condition, the biased locking pin 56 contacts the top of its aperture 22 before each connector head 44 can be brought into axial alignment with the wider upper region of its aperture 22, thereby preventing disconnection. In a preferred form, it is pin head 58 that contacts the top of aperture 22 to lock beam 12 in place. However, it is apparent that the pin shank 60 could be arranged to do so. In this case, when pin head 58 is biased in a rest position, it will not likely be in vertical alignment with shank 42.

A gripping portion, such as grip 64, is preferably provided on locking pin 56 at the end opposite pin head 58 and outside of flange 34. Grip 64 retains the locking pin 56 in the flange hole and allows an axial unlocking force, opposite the biasing force, to be easily applied to biased locking pin 56 to move the locking pin out of the extended position and into a retracted position. When the unlocking force is exerted, the pin shank 60 is pulled through the hole (not shown) in flange 34 and the locking pin 56 is partially or fully removed from aperture 22 and into protective pocket 54. Therefore, the biased locking pin 56 may easily be moved to an unlocked position (FIG. 9) to allow dismantling of the beam 12 from column 14.

While depression 52 and protective pocket 54 have been described above with respect to protecting locking mechanism 50, it also provides clearance for pin head 58 when locking pin 56 is withdrawn from aperture 22.

It can be difficult to make locking pin 56 as strong as desired because it has to slide back and forth in connecting structure 20. When additional strength is required, a locking support 70 (see FIGS. 3*b*, 3*f*, 7*a*–7*c* and 8) can be provided to strengthen locking mechanism 50. Locking support 70 can be attached to front flange 34 in the same manner as the connector 40. As shown in FIGS. 3*a* through 3*h*, when a locking support is included separate right hand and left hand connecting structures can be provided that are virtually mirror images of each other.

In a preferred form, locking support 70 is also used to connect beam 12 and column 14. In a preferred form, locking support 70 has a support shank 72, a support head 74 with an axially thickened portion at one diametrical side thereof defining a support contact surface 76. Like the connector 40, support head 74 of locking support 70 is sized and shaped so as to be capable of passing through the wider, upper region of aperture 22 to a first position. Support head 74 is preferably not capable of passing through the narrower, lower region of aperture 22. Likewise, the shank 72 of locking support 70 is sized and shaped so as to be capable of passing through either of the upper and lower regions of aperture 22. Therefore, when end 16 of beam 12 is connected to column 14 by connecting structure 20, support shank 72 of locking support 70 is moved downward to rest in the bottom or lower portion of a aperture 22 in a second position.

Locking support 70 is located adjacent locking pin 56 and the support contact surface 76 faces locking pin 56. In a preferred form, locking support 70 actually contacts locking pin 56.

Locking support 70 works in the following manner. As beam 12 is lifted, locking pin 56 contacts the top of its aperture 22. If locking support 70 is not already in contact with locking pin 56, they will come into contact by reason of slight tilting of the locking pin 56 when a large lifting force is applied to beam 12, so that the column at the top of aperture 22 contacts locking pin 56 and transmits an opposing force against locking pin 56. When locking pin 56 is in contact with locking support 70, locking support 70 supports locking pin 56.

In a preferred form, contact surface 76 is a contoured surface, such as curved concave surface 78, that is adapted to cradle the locking pin 56 and keep it centered on the locking support 70. In this manner, it is difficult for the locking pin 56 to be forced around one side of locking support 70.

Although the embodiment described above illustrates a connecting structure flange 34 having two connectors 40, a differing number of connectors 40 can be utilized with the invention. For example, flanges 34 having one or three connectors have been contemplated. Likewise, the connectors could include numerous other shapes, including the hook-like connectors shown in the aforementioned U.S. Pat. No. 4,074,812. Likewise, the locking mechanism 50 shown can be alternatively located on side flange 32 and further adapted to lock into a hole provided on one side of column 12. Furthermore, while helical compression spring 62 is illustrated, different types of biasing members could be utilized that need not encircle pin shank 60.

While particular embodiments of the present invention have been shown and described, it will be obvious to those skilled in the art that changes and modifications may be made without departing from the invention in its broader aspects. The matter set forth in the foregoing description and accompanying drawings is offered by way of illustration only and not as a limitation.

We claim:

1. An adjustable rack system comprising:

a first rack member having a plurality of openings;

a second rack member having a connecting bracket including a recessed portion on a first surface of the connecting bracket and a plurality of connectors extending from the first surface in a first direction, the connectors being adapted for insertion in the first direction into the openings to a first position and movement from the first position in a second direction orthogonal to the first direction to a second position;

a locking pin carried by the connecting bracket and adapted for movement between an extended position where the locking pin projects beyond the recessed portion in the first direction and into an aperture in the first rack member and a retracted position where the locking pin does not project beyond the recessed portion in the first direction; and a biasing member coupled to the locking pin and located at least partially in the first direction with respect to the first surface, the biasing member biasing the locking pin towards the extended position, wherein a majority of the first surface of the connecting bracket lies substantially flat against the first rack member when the connectors are in the second position.

2. The adjustable rack system of claim 1, wherein the recessed portion is located along a free edge of the connecting bracket.

3. The adjustable rack system of claim 1, wherein the locking pin includes a grip, a shaft and a head, the head is located in the first direction with respect to the first surface of the connecting bracket and the grip is located in a third direction, opposite the first direction, with respect to the first surface of the connecting bracket, and wherein the biasing member is a coil spring surrounding the shaft of the locking pin and at least a portion of the spring is located between the first surface of the connecting bracket and the head of the locking pin.

4. The adjustable rack system of claim 1, wherein the connecting bracket is a substantially L-shaped connecting bracket.

5. The adjustable rack system of claim 4, further comprising a support coupled to the second rack member in such a manner that a portion of the support is adjacent the locking pin.

6. The adjustable rack system of claim 5, wherein the portion of the support contacts the locking pin.

7. The adjustable rack system of claim 6, wherein the locking pin contacts the support when sufficient force is exerted against the locking pin in a direction towards the support.

8. The adjustable rack system of claim 5, wherein the support is coupled to the recessed portion of the connecting bracket.

9. The adjustable rack system of claim 8, wherein the support further comprises a support surface adapted to prevent the locking pin from slipping out of contact with the support.

10. The adjustable rack system of claim 9, wherein the support surface is a concave surface adapted to cradle the locking pin.

11. The adjustable rack system of claim 10, wherein the support comprises a connector that extends from the first surface in the first direction, the support adapted for insertion in the first direction into at least one of the plurality of openings to the first position and movement in the second direction orthogonal to the first direction.

12. The adjustable rack system of claim 11, wherein the connectors are headed connectors and the openings are teardrop shaped.

13. An adjustable rack system comprising:

a column having a plurality of teardrop shaped slots;

a beam having a connecting bracket including a plurality of connectors extending from a first surface in a first direction and an indentation formed by a portion of the first surface, wherein the connectors are adapted for insertion in the first direction into an upper portion of the teardrop shaped slots to a first position and movement from the first position in a second direction orthogonal to the first direction to a second position within a lower portion of the teardrop shaped slots;

a locking pin extending through an aperture in the indentation, the locking pin being movable between an extended position where the locking pin projects beyond the indentation in the first direction and a retracted position where the locking pin does not project beyond the indentation in the first direction; and a spring coupled to the locking pin and located at least partially within the indentation, the spring biasing the locking pin towards the extended position, wherein the spring biases the locking pin into a portion of one of the teardrop shaped slots when the connectors are in the second position.

14. The adjustable rack system of claim 13, wherein a majority of the first surface of the connecting bracket lies substantially flat against the column when the connectors are in the second position.

15. The adjustable rack system of claim 13, further comprising a locking pin support coupled to the beam in such a manner that a portion of the locking pin support is adjacent the locking pin.

16. The adjustable rack system of claim 15, wherein the locking pin support is coupled to the indentation in the connecting bracket.

17. The adjustable rack system of claim 16, wherein the locking pin support further comprises a surface adapted to prevent the locking pin from slipping around the support.

18. An adjustable rack system comprising:

a first rack member having a plurality of openings; a second rack member having a connecting bracket including a first surface and a plurality of connectors extending from the first surface in a first direction, the connectors being adapted for insertion in the first direction into the openings to a first position and movement from the first position in a second direction orthogonal to the first direction to a second position;

a locking pin coupled to the second rack member for movement between an extended position where the locking pin projects in the first direction into an aperture in the first rack member and a retracted position where the locking pin starts to withdraw from the aperture;

a locking pin support extending from the first surface in the first direction and positioned so a portion of the support is adjacent the locking pin the portion located in the first direction with respect to the first:and surface, wherein the locking pin contacts the portion when sufficient force is exerted against the locking pin in a direction towards the support; and a biasing member coupled to the locking pin and biasing the locking pin towards the extended position.

19. The adjustable rack system of claim 18, wherein the locking pin support further comprises a support surface adapted to prevent the locking pin from slipping out of contact with the support.

20. The adjustable rack system of claim 18, wherein the locking pin support is adapted for insertion into an aperture comprising at least one of the openings in the first rack member.

21. The adjustable rack system of claim 18, wherein at least one of the plurality of connectors comprises the locking pin support.

22. A connector for coupling a first rack member to a second rack member, the connector comprising:

a first surface including a recessed portion;

a plurality of studs extending from the first surface in a first direction;

a locking pin carried by the recessed portion and adapted for movement between an extended position where the locking pin projects beyond the recessed portion in the first direction and a retracted position where the locking pin does not project beyond the recessed portion in the first direction;

a biasing member coupled to the locking pin and located at least partially in the first direction with respect to the first surface, the biasing member biasing the locking pin towards the extended position; and a support adjacent the locking pin, wherein the locking pin contacts the support at least when sufficient force is exerted against the locking pin in a direction towards the support.

23. The connector of claim 22, wherein the support further comprises a support surface adapted to prevent the locking pin from slipping out of contact with the support.

24. An adjustable rack system comprising:

a first rack member having a plurality of openings;

a second rack member having a connecting bracket including a first surface having a portion thereof defining a recessed portion and a plurality of connectors extending from the first surface in a first direction, the connectors being adapted for insertion in the first direction into the openings to a first position and movement from the first position in a second direction orthogonal to the first direction to a second position;

a locking pin carried by the recessed portion of the connecting bracket and adapted for movement between an extended position where the locking pin projects beyond the recessed portion in the first direction and into an aperture in the first rack member and a retracted position where the locking pin does not project beyond the recessed portion in the first direction; and a biasing member coupled to the locking pin and located at least partially in the first direction with respect to the first surface, the biasing member biasing the locking pin towards the extended position.

25. The adjustable rack system of claim 24, wherein a majority of the first surface of the connecting bracket lies substantially flat against the first rack member when the connectors are in the second position.

26. The adjustable rack system of claim 24, wherein the connecting bracket is a substantially L-shaped connecting bracket and the recessed portion is located along a free edge of the L-shaped connecting bracket.

27. The adjustable rack system of claim 24, further comprising a support extending from the first surface in the first direction and positioned so a portion of the support is adjacent the locking pin.

28. The adjustable rack system of claim 27, wherein the portion of the support contacts the locking pin at least when sufficient force is exerted against the locking pin in a direction towards the support.

29. The adjustable rack system of claim 27, wherein the support is coupled to the recessed portion of the connecting bracket.

* * * * *

UNITED STATES PATENT AND TRADEMARK OFFICE

CERTIFICATE OF CORRECTION

PATENT NO. : 6,352,164
DATED : March 5, 2002
INVENTOR(S) : Hyatte, R. et al.

It is certified that error appears in the above-identified patent and that said Letters Patent is hereby corrected as shown below:

Column 7,
Line 32, after "pin" insert -- , --.
Line 33, "first: and surface," should read -- first surface --.

Signed and Sealed this

Eleventh Day of June, 2002

*Attest:*

*Attesting Officer*

JAMES E. ROGAN
*Director of the United States Patent and Trademark Office*